United States Patent [19]

Gay

[11] 4,171,760

[45] Oct. 23, 1979

[54] CARRIER APPARATUS FOR A PACKHORSE

[76] Inventor: Larry D. Gay, Sweetwater Lake Resort, Gypsum, Colo. 81637

[21] Appl. No.: 834,159

[22] Filed: Sep. 19, 1977

[51] Int. Cl.[2] ..... B68C 1/20

[52] U.S. Cl. ..... 224/241; 224/905

[58] Field of Search ..... 224/32 A, 34, 42.43, 224/43.44, 42.46 R, 43, 44, 32 R, 47; 280/289 A; 108/44; D12/158; D87/5 R; 190/41 R, 51

[56] References Cited

U.S. PATENT DOCUMENTS

| | | | |
|---|---|---|---|
| 112,319 | 3/1871 | Leslie | 224/43 |
| 321,152 | 6/1885 | Stephens | 224/43 |
| 413,501 | 10/1889 | Egger | 224/43 |
| 437,637 | 9/1890 | Anderson | 224/43 |
| 495,908 | 4/1893 | Pembroke | 224/43 |
| 501,821 | 7/1893 | Browne | 224/44 |
| 585,833 | 7/1897 | Reznick | 224/32 R |
| 1,839,862 | 1/1932 | Bartlett | 224/43 X |
| 3,349,978 | 10/1967 | Litte et al. | 224/43 |

FOREIGN PATENT DOCUMENTS

| | | | |
|---|---|---|---|
| 840399 | 1/1939 | France | 224/43 |
| 1086064 | 7/1953 | France | 224/32 A |
| 1090075 | 9/1953 | France . | |
| 26505 | of 1902 | United Kingdom | 224/32 A |
| 446331 | 4/1936 | United Kingdom | 224/32 A |
| 502403 | 3/1939 | United Kingdom . | |

*Primary Examiner*—Trygve M. Blix
*Assistant Examiner*—Winston H. Douglas
*Attorney, Agent, or Firm*—James R. Young; John E. Reilly

[57] ABSTRACT

Carrier apparatus for a packhorse includes a pair of cabinets, each constructed of a rigid, unitary shell of upwardly convergent configuration having a door forming an inclined front panel portion also serving as a table in open position and removable, internal shelf separations for carrying items of various sizes. Each cabinet is contoured on the rear or inner side thereof to generally conform to the sides of the packhorse. Nylon straps or mounting frames suspend the cabinets on each side of the horse in a balanced arrangement from a pair of cross bucks. Further, each cabinet has a flat, rigid base, a flat, horizontal top surface, and substantially vertical rear side extending downwardly from an upper concave surface forming a part of the shell so that when the cabinets are removed from the horse they can be placed back-to-back on the ground with no other support such that the combination of the top surfaces provides an additional enlarged flat working surface or table top.

7 Claims, 4 Drawing Figures

CARRIER APPARATUS FOR A PACKHORSE

BACKGROUND OF THE INVENTION

The present invention relates to carrying apparatus and more specifically to carrier apparatus for a packhorse.

People have long recognized the utility of horses and mules for carrying or transporting articles over rough terrain unaccessible to vehicles. Of course, it is necessary to provide appropriate apparatus for retaining the cargo or articles on the horse. Accordingly, in addition to simply strapping or tying the articles on the horse's back, numerous specialized container apparatus have been developed for particular purposes. For example, the U.S. Pat. Nos. issued to J. Anderson, No. 437,673; W. Pembroke, No. 495,908; and J. Smoot, No. 554,843, all disclose the general concept of cabinet-like containers in the form of saddle bags which can be suspended on opposite sides of a pack animal for carrying medical supplies and the like. Typically, these devices employ a leather outer casing which contains metallic canisters or the like, some of which also utilize side-opening drawers or doors. U.S. Pat. No. 112,819 issued to A. Leslie, and U.S. Pat. No. 321,152 issued to J. Stephens, also disclose saddlebags in the concept of pairs of cargo containers cabinets for horse mounting and having hinged access openings.

The C. Little et al U.S. Pat. No. 3,349,978 discloses a novel rack apparatus for suspending a plurality of bulky items over the back of an animal for balanced suspension, each segment of the rack being interconnectable via a hook arrangement. The British Pat. No. 502,403 issued to A. Hellemaa also discloses a pair of heavy cargo suspending hook apparatus adapted for carrying military hardware, including a yoke assembly interconnectable over the back of the animal for balanced cargo suspension. This patent also discloses somewhat contoured side padding which conforms to the sides of the animal. The French Pat. No. 1,090,075 is also of some interest in that it appears to show a frame-like structure for a saddlebag configuration.

While several of the prior art patents discussed above disclose compartmentalized saddlebags for carrying a limited supply of small articles, and the Little and Hellemaa patents disclose devices for suspending large, bulky objects over the back of an animal, there exists a need for enclosed apparatus of larger capacity for carrying the modern needs and requirements of campers and recreational packers in a convenient, easily accessible manner that can also serve the needs of working surfaces and tables for preparing and serving food, writing surfaces and other requirements.

SUMMARY OF THE INVENTION

Accordingly, it is an object of the present invention to provide a cabinet that can be suspended from the back of a pack animal comprised of a relatively large, rigid housing enclosing a storage chamber inside, horizontal shelves dividing the chamber into a plurality of compartments and providing a surface on which objects can be placed and stored, an access door in the housing to provide convenient access to all portions of the chamber and which has a substantially flat, horizontal full open position to alternatively serve as a table or working surface, and suspension means for suspending the cabinet on a pack animal.

It is also an object of the present invention to provide a packhorse cabinet which has a substantially horizontal and flat base on which the cabinet can be set and supported in an upright position when not suspended on a pack animal.

A still further object of the present invention is to provide a pair of such cabinets for suspension on each side of a pack animal from a pair of cross bucks, including suspension means which can be conveniently attached to the cross bucks and which can be conveniently removed from the cross bucks without complication to remove the cabinets for setting on the ground.

A still further object of the present invention is to provide a pair of such cabinets having substantially horizontal top and vertical backs such that the tops of the two cabinets in combination provide an enlarged working surface or table when the two cabinets are set back-to-back on the ground.

Yet another object of the present invention is to provide a rigid cabinet that can be suspended in an upright disposition from the back of a pack animal but which can substantially conform to the shape of the animal's side for both increased stability and comfort to the animal over sustained periods of time.

The preferred form of invention includes a pair of rigid cabinets in the form of unitary shells for containing a large quantity of numerous articles and means for suspending the cabinets on a pack animal. It includes outwardly and downwardly opening doors along a front inclined panel portion to provide convenient access to the articles inside, closing securely when not in use, and providing a working surface when in the full open position. Each cabinet has a flat, rigid base for supporting the cabinet in a stable, upright position when not on the pack animal, and further including a concave panel portion continuing downwardly into a substantially vertical back portion and a flat, horizontal top so that the two cabinets can be set together in back-to-back relation to each other to form an additional enlarged working surface or table top for use in camp. The inclined doors are hinged along their bottom edges to the front panels of the cabinets a spaced distance above the bottom of the cabinet both to retain the door above the ground when used as a working surface and to allow a completely enclosed compartment in the bottom portion of the cabinet. Removable shelves divide the upper part of the cabinet into additional compartments.

An adjustable strap passed under the animal's belly and attached to the bottom portion of the cabinet retain the cabinets snugly against the sides of the animal, and a contoured generally concave back panel portion on each cabinet allows the cabinet to confirm to the general shape of the pack animal's side so that each will depend downwardly in a generally vertical attitude along opposite sides of the packhorse's belly.

BRIEF DESCRIPTION OF THE DRAWINGS

Other advantages, capabilities and features of the present invention will become apparent as the description proceeds taken in conjunction with the accompanying drawings in which.

DETAILED DESCRIPTION OF THE PREFERRED EMBODIMENT

Figure 1:
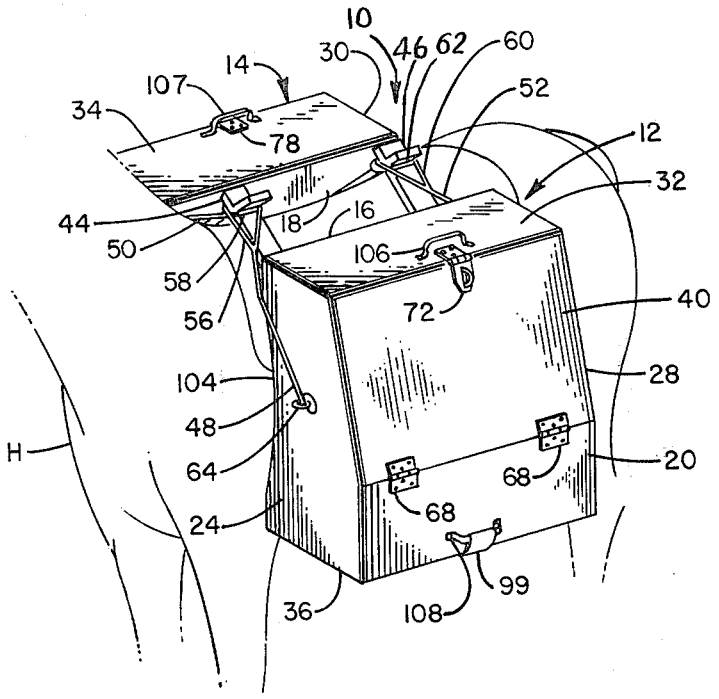
FIG. 1 is a perspective view of a pair of cabinets of the present invention suspended from a pair of cross bucks on a packhorse's back.

Carrying apparatus 10 in accordance with the present invention is shown in FIG. 1 in the form of two cabinets 12, 14 in the form of unitary shells suspended on opposite sides of a horse from a pair of cross bucks 44, 46 on the horse's back. Each cabinet is comprised of a rigid housing or shell enclosing a storage chamber for containing a relatively large quantity of articles, both large and small. The rigid housing of each cabinet, respectively, is comprised of a back panel 16, 18, front panel 20, 22, one side panel 24, 26, a second side panel 28, 30, in substantially parallel, spaced-apart relation to the first side panel, a bottom panel 36, 38, and a top panel 32, 34.

Figure 2:
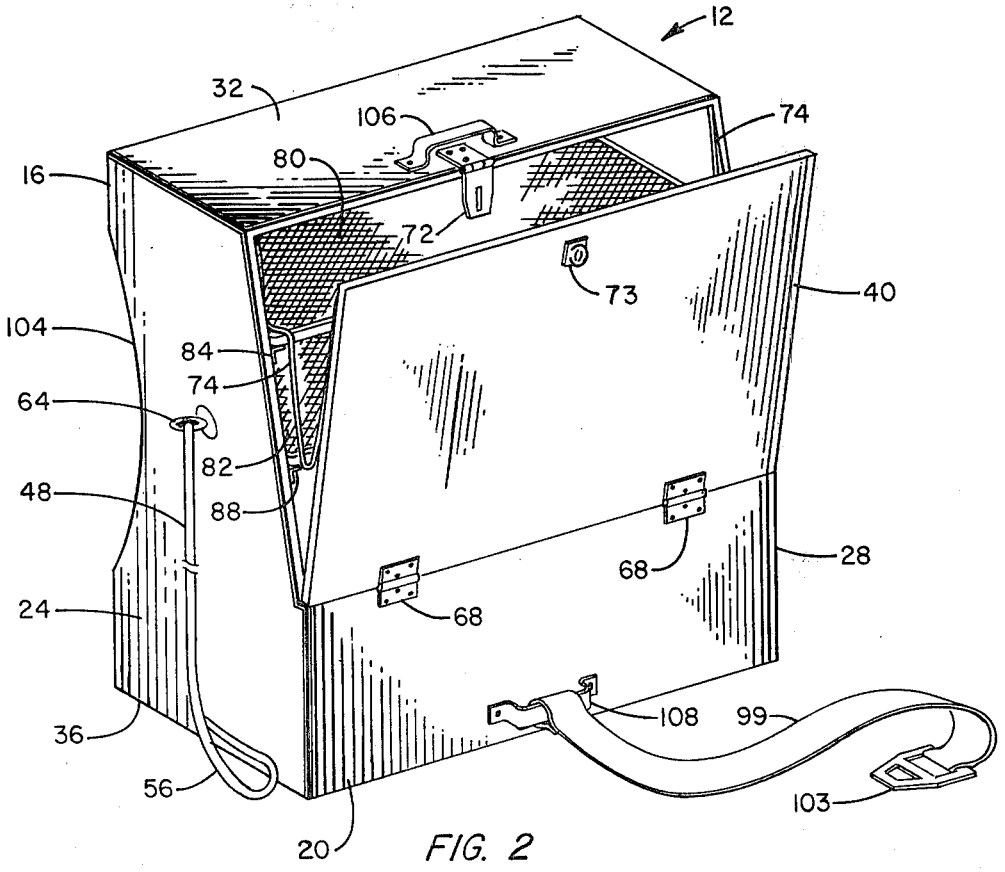
FIG. 2 is an enlarged perspective view of one of the cabinets with the access door partially open.
Figure 3:
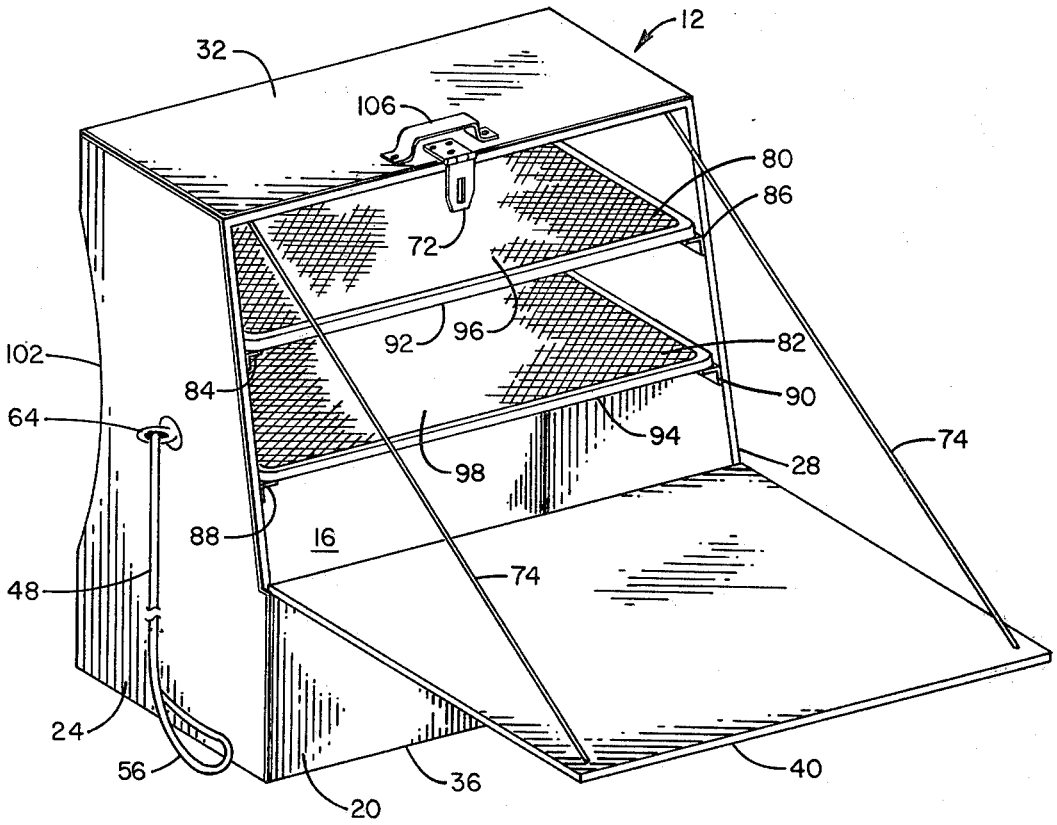
FIG. 3 is a similar enlarged perspective view with the access door shown in a fully open horizonal position.
Figure 4:
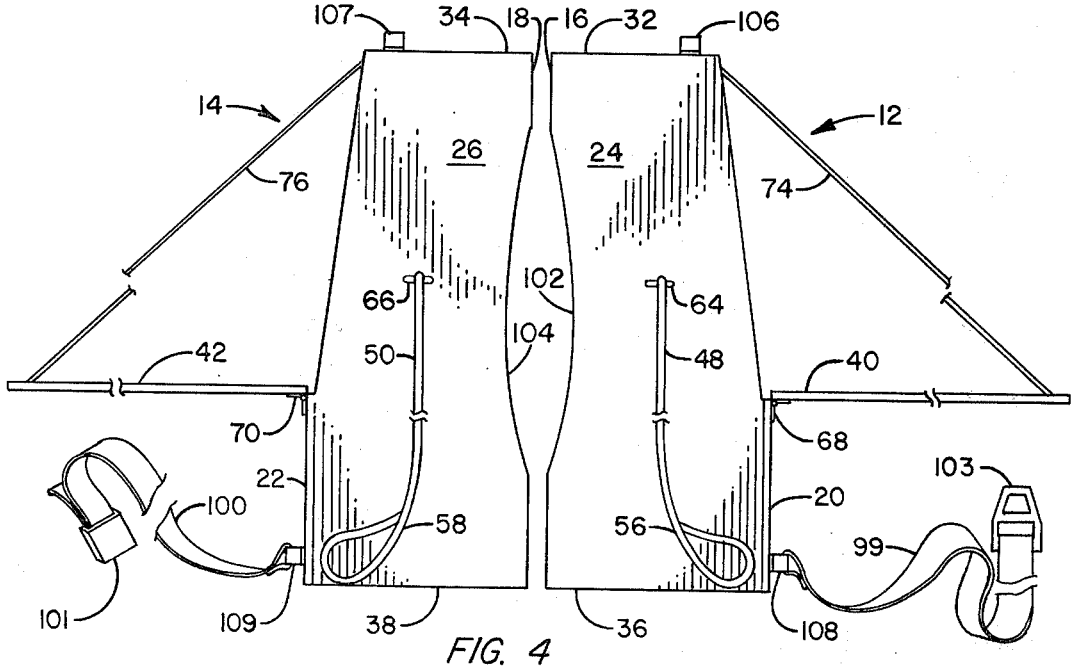
FIG. 4 is an end view of both cabinets positioned back-to-back to illustrate the flat surfaces available for working or use as a table.

Access to the chamber within each cabinet, respectively, is allowed through an inclined door 40, 42, hinged along its respective bottom edge to the respective front panels 20, 22, by hinges 68, 70, such that each door 40, 42 pivots about its closed position as shown in FIG. 1 outwardly and downwardly as shown in FIG. 2 to its full open position as shown in FIGS. 3 and 4. In the full open position, access door 40 is retained in substantially horizontal position by flexible cables 74, and door 42 of cabinet 14 is similarly retained in full open position in a substantially horizontal plane by flexible cable 76. Thus, in the full open position each door 40, 42 serves as a table or working surface for preparing food, writing, and such, both while the cabinets are on the horse or set on the ground in camp.

The cross bucks 44, 46, are conventional and provide means for supporting the carrying apparatus 10 of the present invention on the horse's back. The cabinet 12 is suspended on the left side of the horse by flexible cords 48, 52, each of which is attached by eye bolts 64 to opposite side panels 24, 28, respectively. Each cord 48, 52, includes a permanent enclosed loop 56, 60 at their respective distal ends for placing over the cross bucks 44, 46. The cabinet 14 is similarly suspended on the right side of the horse from the cross bucks 44, 46 by flexible cords 50, 54 which are also attached to opposite sides of cabinet 14 by eye bolts 66 and have permanent loops 58, 62 at their distal ends for placing over the cross bucks 44, 46.

For ease of handling, cabinet 12 is also provided with a handle 106 on its top panel 32 and another handle 108 toward the bottom of its front panel 20. Cabinet 14 has similar handles 107 in its top panel and 108 near the bottom of its front panel. These handles, in combination with the permanent loops in the distal ends of the suspension cords just described enhance handling of the cabinets while placing them on and removing them from the horse.

The bottom panels 36, 38 of the cabinets are flat and rigid to provide a base for supporting the cabinets in stable, upright position when removed from the horse at campsite without the necessity of supporting trees, rocks, or the like. The top panels 32, 34 are also flat and horizontal, and the back panels are substantially vertical so that the cabinets can be set in back-to-back relation to each other in camp with the top panels in combination forming an additional enlarged working surface or table for preparing and eating meals.

In order to further stabilize the cabinets during transport, the lower ends of the respective cabinets, 12, 14, are tied together with belly straps 99, 100 which are attached respectively to lower handles 108, 109 on respective cabinets 12, 14. The straps 99, 100 are pressed under the belly of the pack animal and attached together with an adjustable buckle connector 101 on strap 100 and a buckle insert 103 on strap 99 similar to conventional seat belts on an automobile. An upper portion of each of the substantially vertical back panels 16, 18 are contoured or curved inwardly so as to form a concave surface about a horizontal axis to substantially conform to the animal's side for further stability for the cabinets and comfort for the animal while the cabinets are maintained in substantially vertical attitude on the sides of the horse, thus keeping the internal shelves (described below) in substantially horizontal orientation. The length of the cords 48, 50, 52, 54 are coordinated with the height of the cabinets and the position of the contoured back panels, as well as the size of the horse to maintain an appropriate relation necessary to provide the vertical orientation of the cabinets and horizontal orientation of the shelves therein while being carried by the horse.

As best seen in FIGS. 2 and 3, the cabinets are also equipped with shelves 80, 82, preferably each shelf being removable. Each shelf 80, 82 is comprised of a tubular frame 92, 94, preferably of aluminum or other light but strong metallic material, and the surface of the shelves are comprised of expanded metal screen 96, 98. The upper shelf 80 is supported on opposite ends by angular brackets 84, 86, respectively, and shelf 82 is similarly supported by angular brackets 88, 90. The shelves provide convenient dividers for storing smaller items, or they can be removed and temporarily placed in the bottom of the container if larger items are to be stored in the cabinet.

The inclined door 40 diverges downwardly and is preferably hinged to front panel 20 a spaced distance above the bottom so that the bottom of the chamber forms an enlarged cavity completely enclosed on all four sides for confining larger items and items that may be breakable and for retaining the door above the ground in its full open position when used in camp as a table or working surface as described above. The door is fastened in closed position by hasp 72 which is fastened on top panel 32 and swings down over the top edge of door 40 to fasten to a mating element 73 of the hasp.

An important feature of the present invention resides in the construction and arrangement of each housing so as to diverge downwardly from the top to the bottom panel with an inclined door formed opposite to the upper concave surface of the back panel. Thus, when the door is opened the increasing depth of the enclosure toward the lower end affords better access to the bottom of the enclosure and leads to weight distribution by permitting a larger space at the bottom for storage of bulky items. At the same time the increased weight of the cabinets such that the bottom panels extend beneath the horse's belly establishes a lower center of gravity without projecting unduly away from the sides of the horse.

The housing and door of each cabinet are preferably made of rotationally molded, high density, cross-bonded polypropylene plastic since this material is practically indestructable and will not crack at subzero temperatures nor soften at desert level temperatures, although it could also be made of metal, wood or other suitable material. The unitary rigidity of each cabinet serves to protect lanterns, glass containers, provisions, and packaged materials which are generally carried on camping pack trips, hunting expeditions, and forest service work trips into rough back country areas. The flat upper surfaces of the cabinets and the inner surfaces of the doors when in fully opened position serve as convenient working surfaces for preparing food while providing complete access to the contents of the cabinet in close proximity. The flexible cables 74, 76 for retaining the door in full open position and the flexible cords 48, 50, 52, and 54 are preferably fabricated of Nylon. The door is a convenient working surface for preparing food on lunch stops or for writing while still attached to the animal. The cabinets can also be closed securely and are immune to entry by animals and rodents when left in camp.

For purposes of illustration and not limitation, a description of preferred dimensions for a well proportioned cabinet is provided. The overall height of the cabinet is about 26", and it is about 26" wide and 12" deep at its base. The top surface is 26" wide and 9" deep, with the back edge of the bottom panel and the back edge of the top panel laying on the same vertical plane. The front panel is 26" wide and extends about 10" vertically upward from the front edge of the base, then inclines in the form of a 26" wide door to the front edge of the top panel. The back panel extends about 6" vertically upward from the rear edge of the base panel, then curves inwardly about a horizontal axis to a depth of approximately 4" then back outwardly to meet a portion of the back panel extending about 4" vertically downward from the rear edge of the top panel.

The first shelf is positioned horizontally inside the cabinet about 6" below the top panel, and a second shelf is positioned horizontally about 6" below the first shelf. Thus, the lower compartment is about 15" in height between the bottom panel and the lower shelf with the inclined door opening in the front panel providing about a 5" high and 26" wide access to the lower compartment without moving the lower shelf. Of course, if the lower shelf is removed, the access opening to the lower compartment is significantly bigger.

The door in full open horizontal position provides a working surface about 18" by 26", and, when the two cabinets are positioned back-to-back, the combined upper panels of the two provide another working surface of about 18" by 26". Thus the total working surface available with the two cabinets in back-to-back position and with the door on each cabinet in full open position is almost 10 square feet.

Although the present invention has been described with a certain degree of particularity, it is obvious that this invention is not to be considered limited to the exact form disclosed and that changes in detail and construction may be made therein within the scope of the invention without departing from the spirit thereof.

What is claimed is:

1. A set of packhorse cabinets adapted for carrying on the back of a packhorse, comprising:

a pair of rigid cabinets, each of which has a rectangular planar top panel and a rectangular planar bottom panel disposed in parallel, spaced-apart, over and under relation to each other with the back edges of said top and bottom panels in vertical alignment with each other, a right side panel extending between the right sides of said top and bottom panels, a left side panel extending between the left sides of said top and bottom panels, a back panel extending between the back edges of said top and bottom panels, and a front panel extending substantially vertically upwardly from the front edge of said bottom panel a portion of the distance between said top and bottom panels, each of said top, bottom, right, left, back, and front panels being rigid in character and rigidly joined with adjacent of said panels, each said back panel having a concave intermediate recessed portion therein adapted to conform to the exterior of the abdominal wall of a packhorse on which said cabinets are positioned for carrying, each said back panel having upper and lower substantially vertical portions interconnecting said concave portion with said top and bottom panels respectively, the curvature of said concave portions being such that said cabinets are adapted to be suspended on opposite sides of a packhorse in an upright orientation, each of said cabinets also including a planar downwardly and outwardly opening door which is hinged along its bottom edge to the top edge of said front panel and which is oriented horizontally in parallel relation to the plane of said top and bottom panels when in its full open position, and suspension means adapted for suspending each of said cabinets on opposite sides of a packhorse, said cabinets also being adapted for positioning together in upright, back-to-back relation to each other on the ground when not suspended on a packhorse with said upper vertical portions of said cabinet and lower vertical portions of said cabinets positioned in confronting relationship such that said top panels are contiguous to each other in the form of individual half sections of a whole, substantially planar, horizontal table top.

2. A set of packhorse cabinets according to claim 1, wherein said shelves are removable and mountable in alternative positions within said chamber.

3. A set of packhorse cabinets according to claim 1, wherein said suspension means includes two flexible straps, each of said straps being connected at one end to opposite of said side panels, and each of said straps having a permanent enclosed loop at its distal end adapted for removable attachment to one of a pair of cross bucks placed on a horse's back.

4. A set of packhorse cabinets of claim 1, wherein said door is substantially as wide as said front panel but somewhat shorter than said front panel and is hinged to said front panel a spaced distance upwardly from the bottom of the housing such that the door opening allows full access to said shelf but leaves the lower portion of said chamber fully enclosed on the front, back, two sides, and bottom.

5. A set of packhorse cabinets of claim 1, including an adjustable and releasable belly strap extending from the lower portion of one of said cabinets, under the horse's belly, to the opposite cabinet and adapted to retain said cabinets snug against the horse's sides.

6. A set of packhorse cabinets according to claim 1, wherein said generally concave portion of the back panel of each of said cabinets is contoured with an inward curve about a horizontal axis to conform to the upper side of the horse's belly in order that said cabinets are adapted to depend downwardly on opposite sides of the horse in substantially upright disposition.

7. A set of packhorse cabinets of claim 1, wherein said top panel of each cabinet is narrower than said bottom panel in its forward direction such that the front of the cabinet in its door opening diverges from a narrower top portion to a wider bottom portion in a manner such that the horizontal distance between the front and back of the cabinet in the top portion thereof is approximately the same as the horizontal distance between the front and back of the cabinet in the midportion thereof primarily between the concave portion of the back panel and the door opening, a plurality of shelves removably positioned in the top portion and midportion of the cabinet adapted for retaining objects thereon, the door opening and said door being inclined upwardly and rearwardly from said hinged connection of said door to said front panel over the forward portions of said shelves for enhanced access to contents that may be placed on and under said shelves.

* * * * *